US010321743B2

(12) United States Patent
Strnad

(10) Patent No.: US 10,321,743 B2
(45) Date of Patent: Jun. 18, 2019

(54) SQUARE PRINCESS CUT GEMSTONE

(71) Applicant: Leonard J. Strnad, Bay Village, OH (US)

(72) Inventor: Leonard J. Strnad, Bay Village, OH (US)

( * ) Notice: Subject to any disclaimer, the term of this patent is extended or adjusted under 35 U.S.C. 154(b) by 0 days.

(21) Appl. No.: 14/796,030

(22) Filed: Jul. 10, 2015

(65) Prior Publication Data

US 2016/0007699 A1 Jan. 14, 2016

Related U.S. Application Data

(60) Provisional application No. 62/022,680, filed on Jul. 10, 2014.

(51) Int. Cl.
*A44C 17/00* (2006.01)

(52) U.S. Cl.
CPC ..... *A44C 17/001* (2013.01)

(58) Field of Classification Search
CPC ..... A44C 17/00; A44C 17/001
USPC ..... D11/89, 90; 63/32
See application file for complete search history.

(56) References Cited

U.S. PATENT DOCUMENTS

| | | | | |
|---|---|---|---|---|
| 202,402 | A * | 4/1878 | Bates | A44C 17/02 63/15 |
| 6,745,596 | B2 | 6/2004 | Wueste | |
| D537,379 | S * | 2/2007 | Namdar | D11/90 |
| D550,115 | S * | 9/2007 | Pandya | D11/90 |
| D588,039 | S * | 3/2009 | Renner | D11/89 |
| D596,070 | S * | 7/2009 | Peled | D11/90 |
| 7,992,410 | B2 | 8/2011 | Rydlewicz | |
| 2009/0183525 | A1* | 7/2009 | Hasenfeld | A44C 17/001 63/32 |
| 2013/0019636 | A1 | 1/2013 | Rydlewicz | |
| 2013/0042648 | A1* | 2/2013 | Humbert, Jr. | A44C 17/001 63/32 |
| 2013/0291589 | A1* | 11/2013 | Ritchie | A44C 17/001 63/32 |
| 2017/0303647 | A1* | 10/2017 | Hamers | A44C 17/001 |

* cited by examiner

*Primary Examiner* — Emily M Morgan

(57) ABSTRACT

A square princess cut gemstone (100) comprises a crown (300) having thirteen facets (310, 321-324, 331-334, 345-348). The crown facets include a square table facet (310) forming the top of the crown's truncated pyramid shape. Four upper girdle facets (321-324) extend upward from girdle edges (231-234). Four table-surrounding facets (331-334) extend upward from the upper girdle facets (321-324) to the table facet (310). Four bezel facets (345-348) straddles at least one of the adjoining corners of the upper girdle facets (321-324) and the adjoining corners of the table-surrounding facets (331-334).

9 Claims, 21 Drawing Sheets

SQUARE PRINCESS CUT GEMSTONE

RELATED APPLICATION

This utility application claims priority from U.S. Patent Application No. 62/022,680 entitled, "Square Princess Cut Diamond" filed on Jul. 10, 2014, the entirety of which is hereby incorporated by reference herein.

BACKGROUND

A square princess cut diamond has a square girdle, a crown above the girdle, and a pavilion below the girdle. The crown of a square princess cut diamond has conventionally comprised a central table facet and at least twenty additional facets. Square cut diamonds have traditionally been appraised by intensity (color strength), brightness (light return), fire (color flashes), and scintillation (sparkles).

SUMMARY

A square princess cut gemstone is provided wherein, in one example, the crown includes a square central table facet and twelve additional facets. In one example of the present invention, the crown includes a table facet having a square shape with four sides; four upper girdle facets; four table-surrounding facets; and four bezel facets which at least partially straddles regions of at least one of the corner junctions of the upper girdle facets and regions of the corner junctions of the table-surrounding facets. The gemstone, for example a diamond, is able to present excellent ratings of intensity, brightness, fire, and scintillation. This presentation is possible even when the starting stone has a poor color grade and/or when cut imperfections cause symmetry concessions.

DRAWINGS

The various embodiments of the present invention can be understood with reference to the following drawings. The components in the drawings are not necessarily to scale. Also, in the drawings, like reference numerals designate corresponding parts throughout the several views.

FIGS. 1A-1D show side views of a square princess cut diamond 100 as it is sequentially rotated 90° about a vertical axis, in accordance with an example of the present invention;

FIGS. 2A-2D, FIGS. 3A-3F, and FIGS. 4A-4D show details of the girdle 200, the crown 300, and the pavilion 400, respectively, as the diamond 100 is sequentially rotated 90° about a vertical axis, in accordance to an example of the present invention;

DESCRIPTION

Figure 1A:
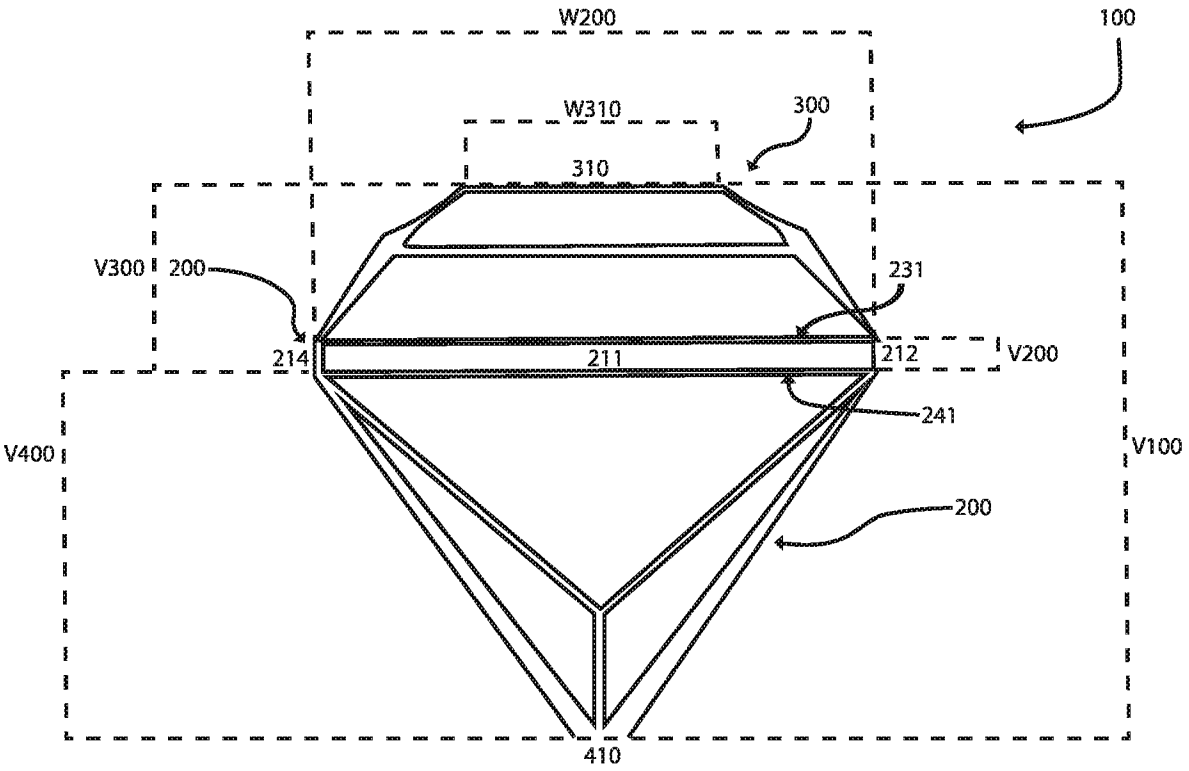
Figure 1B:
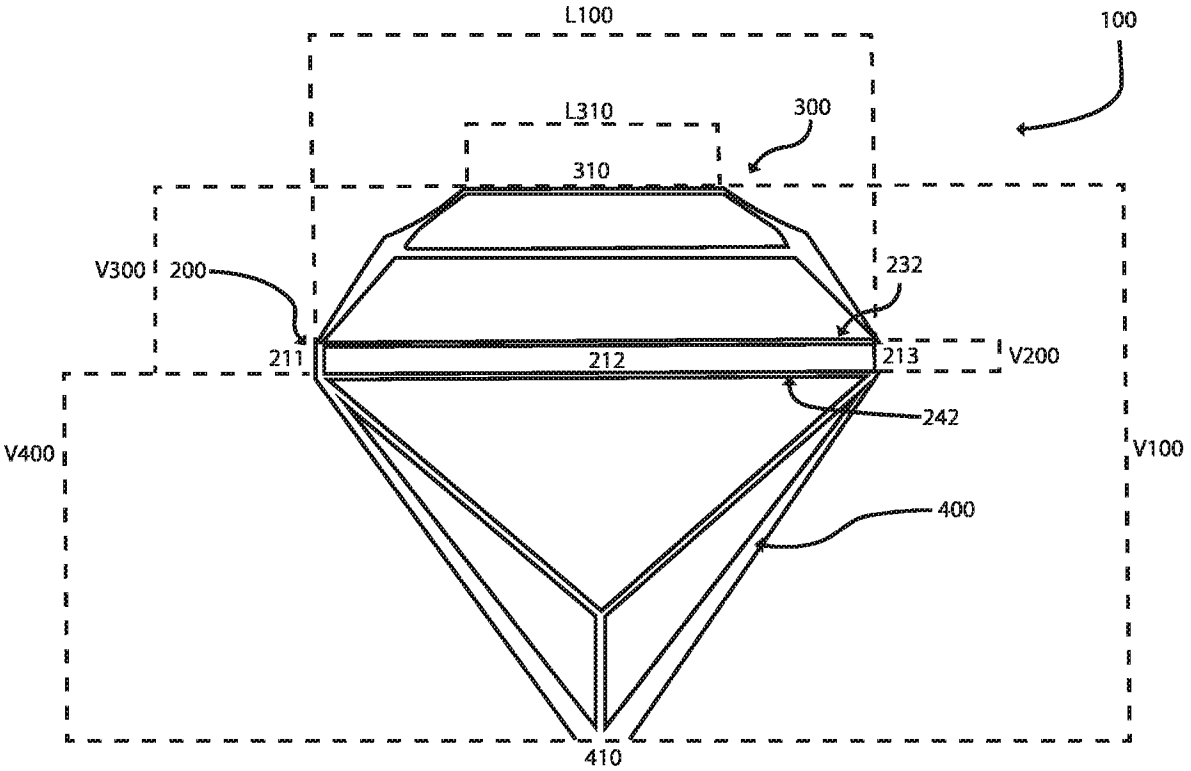
Figure 1C:
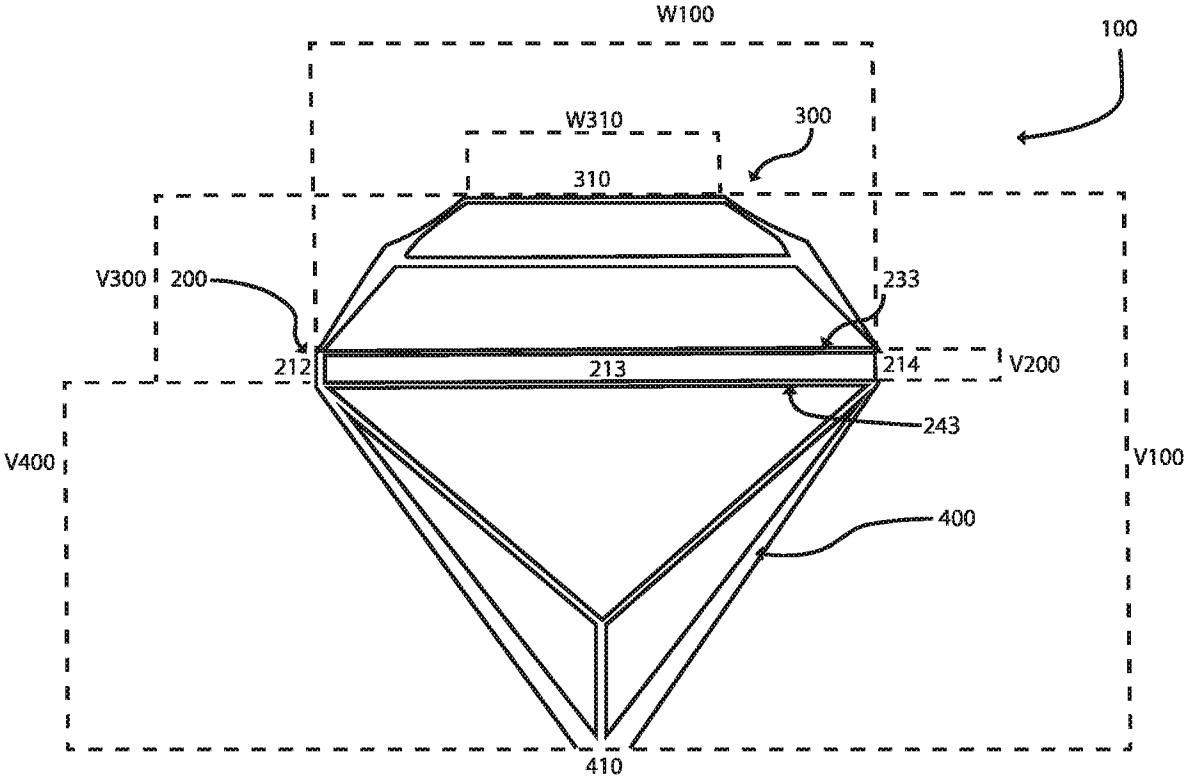
Figure 1D:
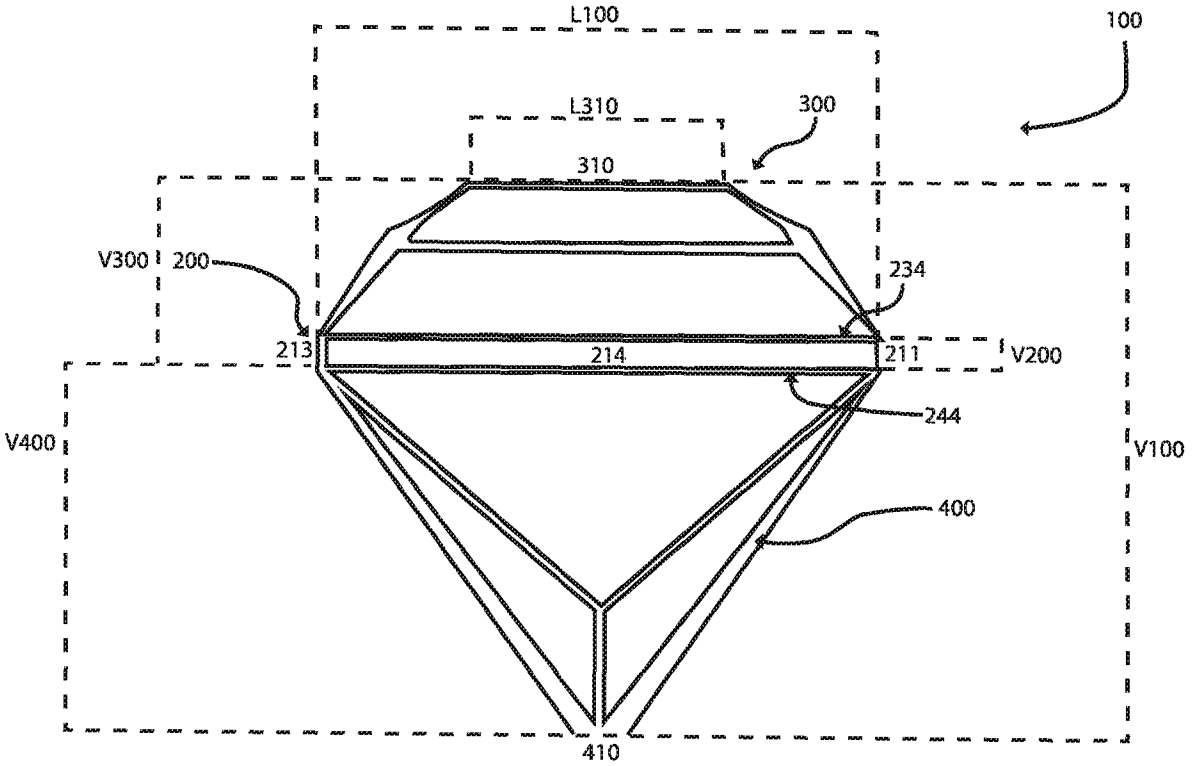
Figure 2A:
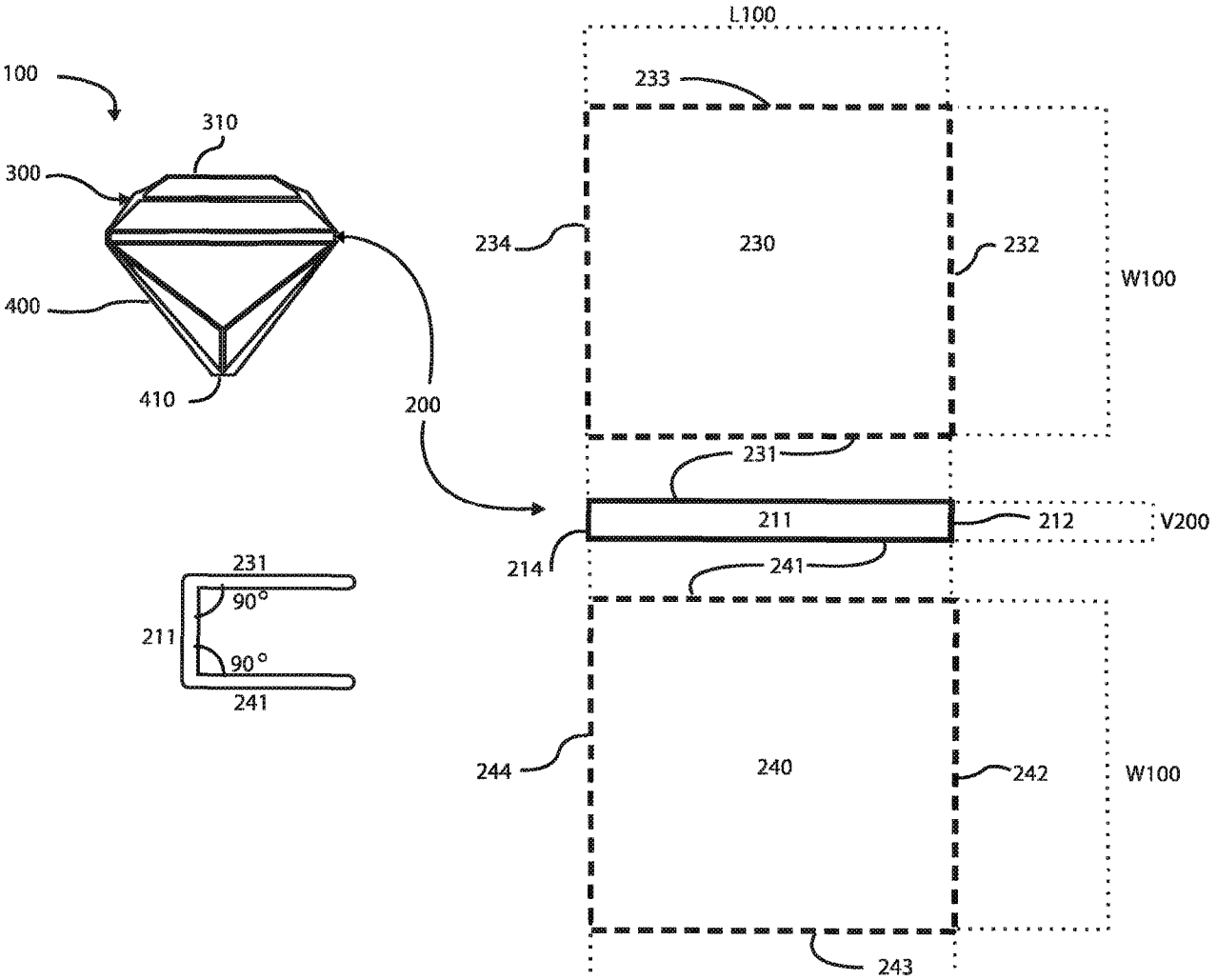
Figure 2B:
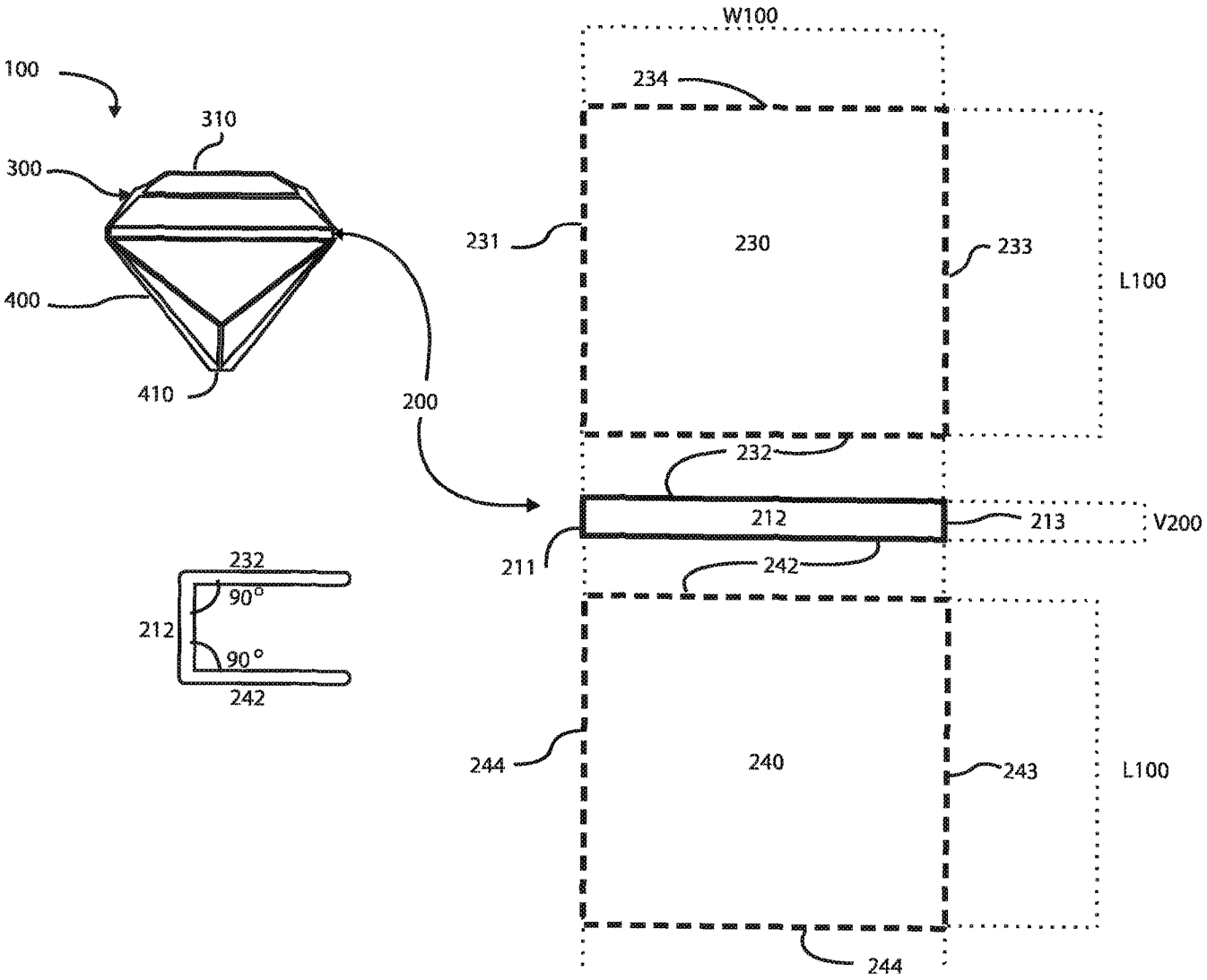
Figure 2C:
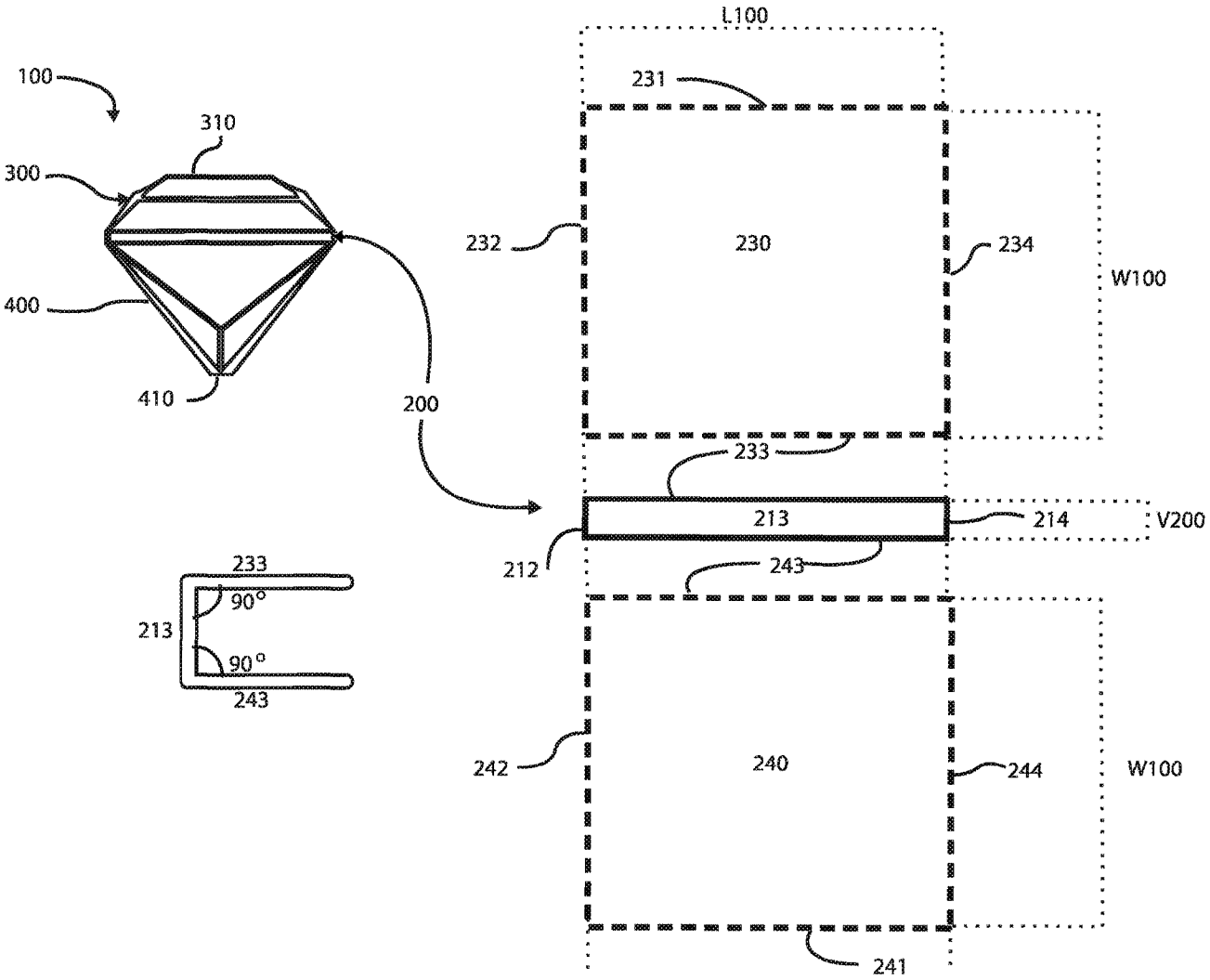
Figure 2D:
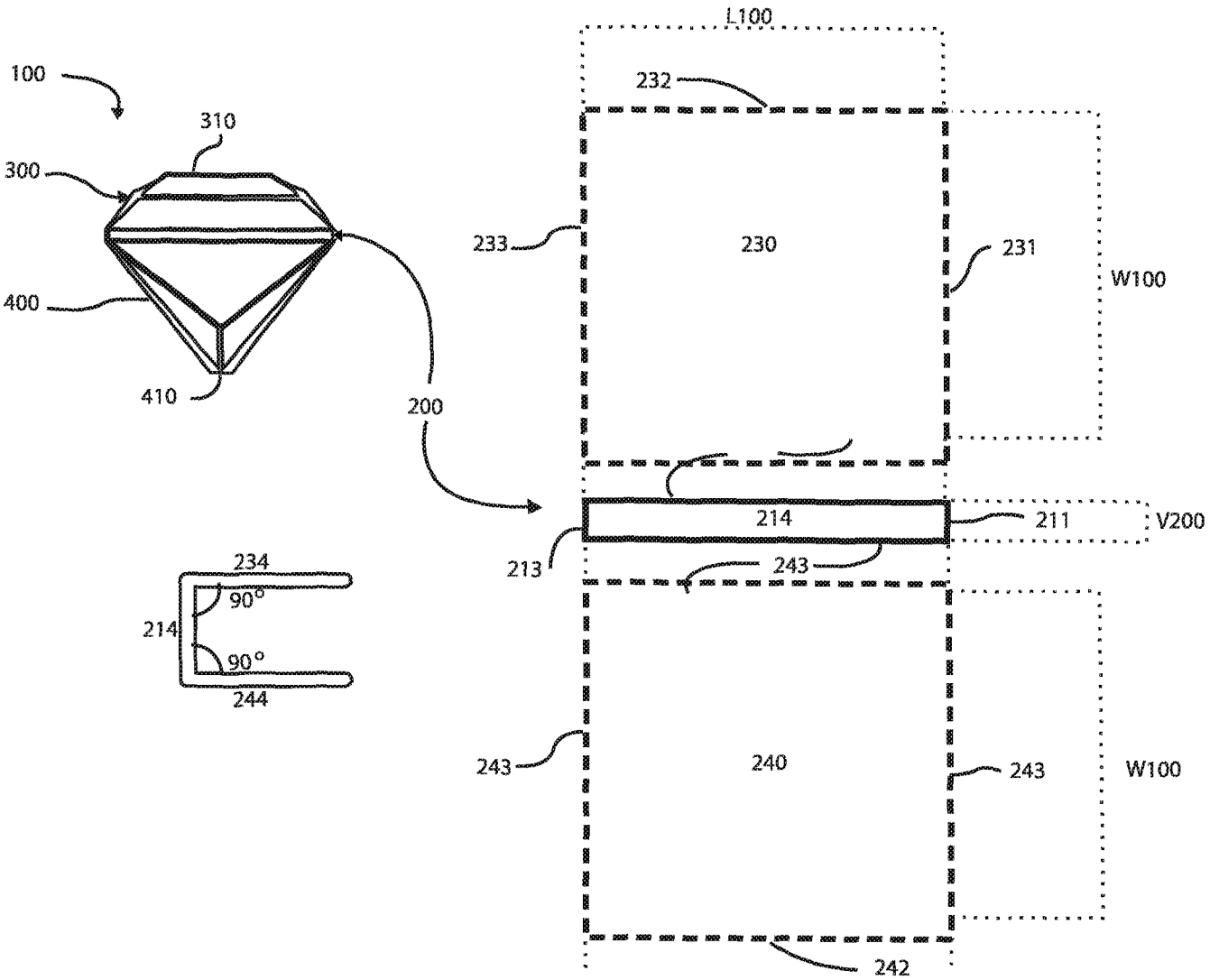

Various examples of a square cut princess gemstone are disclosed herein. In one example a square cut princess gemstone has a crown that includes a square central table facet and at least twelve (12) additional crown facets. That is, the crown has at least thirteen (13) facets including the central table facet. In another example, a square princess gemstone has a crown that includes a square central table and substantially twelve (12) additional crown facets, namely, four table-surrounding facets, four bezel facets, and four upper-girdle facets. The gemstone also has a pavilion which has a plurality of facets. The number of pavilion facets is at least 16 facets and can typically range from 16 to 33, and so the total number of facets of the gemstone is at least about 33 facets and can range from about 33 to about 50 facets.

In another example, the examples of the square cut princess gemstones described above, has a crown that has a square central table facet and twelve additional crown facets has length-width ratio of about 1.0 to about 1.1, or a width-length ratio of about 1.0 to about 1.1. The overall depth ranges from about 80% to about 85%, in another example, about 80% to about 100%, and in another example from about 80% to about 105%. The table size ranges from about 48% to about 54%, and in another example from about 48% to 52%. The princess cut gemstone has a girdle thickness that ranges from greater than about 0% to about 21%, in another example about 0.5% to about 21%, in another example from greater than about 0% to about 7%, and in another example about 6% to about 18%. The crown height ranges from about 15% to about 24%, and in another example, from about 15% to about 18%. The pavilion depth ranges from about 58% to about 65%, and in another example from about from about 60% to about 63%. The gemstone 100 has a crown angle that ranges from about 43° to about 470 and a pavilion angle that ranges from about 39° to 45°, and in another example from about 39° to about 43°. Angle-to-angle tolerances, i.e. between adjacent angles, can be greater than about 2%, greater than about 3%, greater than 4%, in another example up to about 5%, and in other example greater than about 4% and up to about 5%. It has been found that the angle-to-angle tolerances of the example gemstones disclosed herein are greater while maintaining excellent brightness, fire and scintillation.

FIGS. 1A through 1D illustrate square princess cut gemstone 100, for example a diamond or one of a variety of natural or synthetic gem, Gemstone 100 includes a girdle 200, a crown 300, and a pavilion 300. In the illustrated and industry-accepted orientation, the crown 300 is positioned above the girdle 200 and the pavilion 400 is positioned below the girdle 200. A square table facet 310 forms a flat top of the crown 300 and a tip 410 forms the bottommost aspect of the pavilion 400.

The diamond 100 has a length dimension L100 and a width dimension W100. The length dimension L100 is the horizontal distance between one parallel pair of facets of the girdle 200 (i.e., facet 211 and facet 213). The width dimension W100 is the horizontal distance between the girdle's other parallel pair of facets (i.e., facet 212 and facet 214). The diamond 100 can be designated a horizontal dimension H100 which is the average of its width W100 and its length L100. With a perfectly square cut diamond, the length L100 would be exactly equal to the width W100 and the horizontal dimension H100.

The square table facet 310 has a length dimension L310 which runs parallel to the diamond's length dimension L100 and a width dimension W310 which runs parallel to the diamond's width dimension W100. The table facet 310 can be designated a horizontal dimension H310 which is the average of its width W310 and its length L310. Again, with a perfectly square cut diamond, the table length L310 would be exactly equal to the table width W310 and the table horizontal dimension H310.

The diamond 100 also has a vertical dimension V100 which represents its reach from the table facet 310 to the pavilion tip 410. The girdle 200 has a vertical dimension V200 measured between its top edges 231, 232, 233, 234 and its bottom edges 241, 242, 243, 244. The crown 300 has a vertical dimension V300 measured from the girdle's top edges 231, 232, 233, 234 to the table facet 310. The pavilion 400 has a vertical dimension V400 measured from the girdle's bottom edges 241-244 to the tip 410.

With reference to FIG. 1, an example of gemstone 100 which has length-width ratio (W100/L100 or L100/W100) of 1.0 to 1.1, and an overall depth (% V100/H100) that ranges from about 80% to about 105%, in another example about 80% to about 100%, and in yet another example about 80% to 85%. The table size (% H310/H100) can vary and ranges from about 48% to about 54%, and in another example from about 48% to about 52%. Girdle thickness (% V200/H100) can range from greater than about 0% to about 21%, in another example about from 0.5% to about 21%, in another example from greater than about 0% to about 7%, and in another example about 6% to about 18%. The crown height (% V300/H100) can range from about 15% to about 24%, and in another example from about 15% to about 18%. The pavilion depth (% V400/H100) can range from about 58% to about 65%, and in another example from about 60% to about 63%.

FIGS. 2A through 2D illustrate girdle 200 which can be viewed as occupying a rectangular cuboid region of gemstone 100 between the crown 300 and the pavilion 400. This rectangular cuboid region forms the four facets 211, 212, 213, 214 which intersect right corner edges. The facets 211, 212, 213, 214 preferably have essentially identical rectangular shapes oriented in vertical planes. As was indicated above, the length L100 of the diamond 100 is the distance between facet 211 and facet 213, and the width W100 of the diamond 100 is the distance between facet 212 and facet 214.

The facets' upper edges 231, 232, 233, 234 form an upper square perimeter and the facets' lower edges 241-244 form a lower square perimeter. When the girdle 200 is viewed from the top (with the crown 300 theoretically removed), the girdle's upper edges 231, 232, 233, 234 define a horizontal square area 230. When the girdle 200 is viewed from the bottom (with the pavilion 400 theoretically removed), the girdle's lower edges 241-244 define a horizontal square area 240.

The square area 230 and the horizontal square area 240 are parallel (i.e., both oriented in a horizontal plane) and they are vertically aligned. As was indicated above, the girdle's vertical dimension V200 is the vertical distance between the square area 230 and the square area 240. If the diamond 100 is perfectly square, this distance will be the same irrespective of the corresponding coordinates.

As was indicated above, the gemstone 100 can have a girdle thickness (% V200/H100) that ranges from about 0% to about 7%, in another example from about 0.5% to about 21%, and in another example from about 6% to about 18%. However, one advantage of the present princess cut is that it can adopt thicker girdles than traditional square princess cuts without a significant compromise in intensity, brightness, fire, and scintillation. Such a thicker girdle translates into a greater carat weight, an easier stone-cutting process, and increased chip or break resistance. With specific reference to chip or break resistance, it may be noted that square cut stones are particularly vulnerable to such damage due to the perpendicular nature of the girdle facets 211, 212, 213, 214. The larger girdle thickness (% V200/H100) provides larger surface area for gem cutting decoration to inscribe, for example, serial numbers, pattern designs, and personalized scripture. A thicker girdle also provides for new stone setting techniques and alternative methods for securing the gemstone in a setting, for example.

FIGS. 3A through 3D illustrate crown 300 which has a generally truncated-top pyramid shape with its lower base formed by the girdle's upper face 230. Thus the crown 300 has a square base defined by the girdle's upper edges 231, 232, 233, 234. The table facet 310 forms the horizontal truncated-top of the crown's pyramid shape and the four sides of its square shape run parallel to the upper girdle margins 231, 232, 233, 234.

The crown 300 has four upper girdle facets 321-324, four table-surrounding facets 331-334, and four bezel facets 345-348. Thus, the gemstone 100 includes table facet 310 and these twelve additional facets. In one example, gemstone 100 has a maximum of thirteen crown facets including table facet 310, as shown in FIG. 3. In this example, the thirteen crown facets have been found to be capable of conveying high intensity, excellent brightness, excellent fire, and excellent scintillation. This contradicts traditional wisdom that a greater number of crown facets is better when it comes to these performance properties.

The upper girdle facets 321-324 each have a bezel-modified trapezoidal shape, for example each having four or six sides, and each upper girdle facet 321-324 is preferably approximately equal in geometry, that is, approximately equal in shape and size, although variances in size and shape are possible while maintain excellent results. The lower and longer margins 351-354 of the upper girdle facets 321-324 coincide with the girdle's upper edges 231, 232, 233, 234. The upper and shorter margins 361-364 of the upper girdle facets 321-324 are positioned parallel to the longer margins 351-354, but upward and inward therefrom.

The side margins 371-374 of each upper girdle facet 321-324 slant inwardly to extend between the facet's lower margins 351-354 and upper margins 361-364. The contour of these side margins 371-374 will deviate (for example, compared to the straight side margins found in a non-modified trapezoidal shape) to trace the four sides of bezel facets 345-348. The bezels, for example, can have a general parallelogram shape. In another example the bezel is shaped like a kite as shown. The slanted side margins 371-374 of the upper girdle facets 321-324 merge along a portion of the upper girdle facets, and also merge with bezel facets 345-348 along a portion of the upper girdle facets.

The upper girdle facets 321-324 slant upward from a horizontal plane (e.g., the square area 230 defined by the girdle's upper edges 231, 232, 233, 234) at angles A321-A324. The average of these upper-girdle-facet angles is considered the crown angle of the diamond 100. As was indicated above, the gemstone 100 has a crown angle that ranges from about 35° to about 50°, and in another example, from about 43° to 47° depending upon the collective features of the princess cut gemstone.

The table-surrounding facets 331-334 also have bezel-modified trapezoidal shapes, for example each having four or six sides. The table-surrounding facets 331-334 are preferably approximately equal in geometry, for example, substantially equal in size and shape. The lower and longer margins of the table-surrounding facets 331-334 coincide with upper margins 361-364 of the upper girdle facets 321-324. The upper and shorter margins 391-394 of the facets 331-334 are positioned parallel to their longer margins 361-364, but upward and inward therefrom. They merge with the outer perimeter sides of the table facet 310. The bezel-tracing slanted side margins 381-384 of the facets 331-334 merge with each other and/or the bezel facets 345-348.

The table-surrounding facets 331-334 slant upward from a horizontal plane at angles A331-A334. The table-surrounding-facet angles A331-A334 are less than the upper-girdle-facet angles A321-A324 and thus they are less than the diamond's crown angle. The table-surrounding-facet angles A331-A334 range from about 20° to about 30°, and in another example from about 22° to about 27°.

In one example the bezel facets (345, 346, 347, 348) each have four sides and have a general parallelogram shape. In another example The bezel facets 345, 346, 347, 348 each have four sides and are a kite shape with a bridal portion 345*a*, 346*a*, 347*a*, 348*a* (the larger triangle) and a knot portion 345*b*, 346*b*, 347*b*, 348*b* (the smaller triangle). The bridal portions straddle regions of the corners of adjacent pairs of upper girdle facets 321-324 so as to modify the otherwise trapezoidal shape of these facets. The knot portions straddle regions of the corners of adjacent pairs of table-surrounding facets 341, 342, 343, 344 so as to modify their otherwise trapezoidal shape.

Figure 3A:
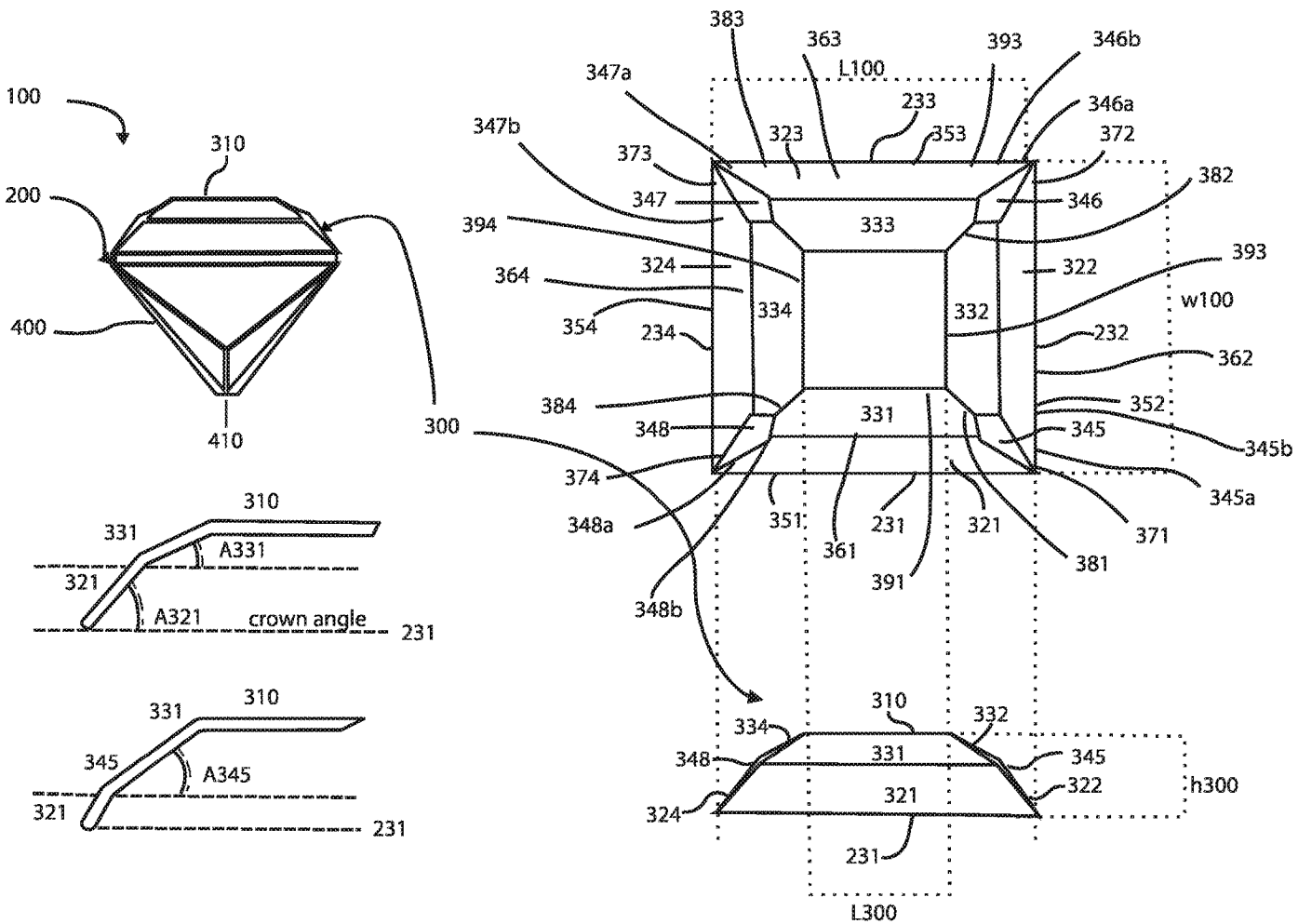
Figure 3B:
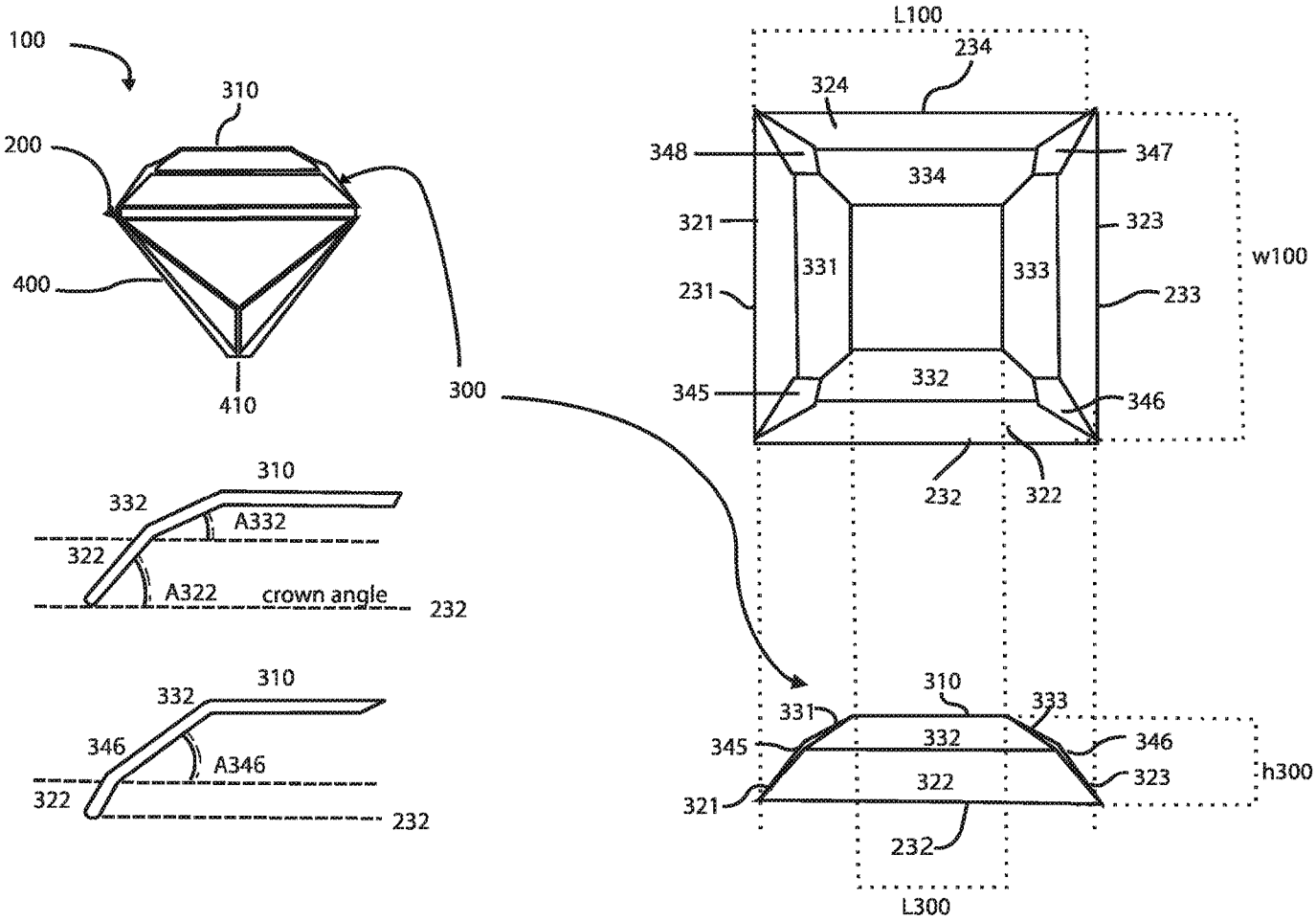
Figure 3C:
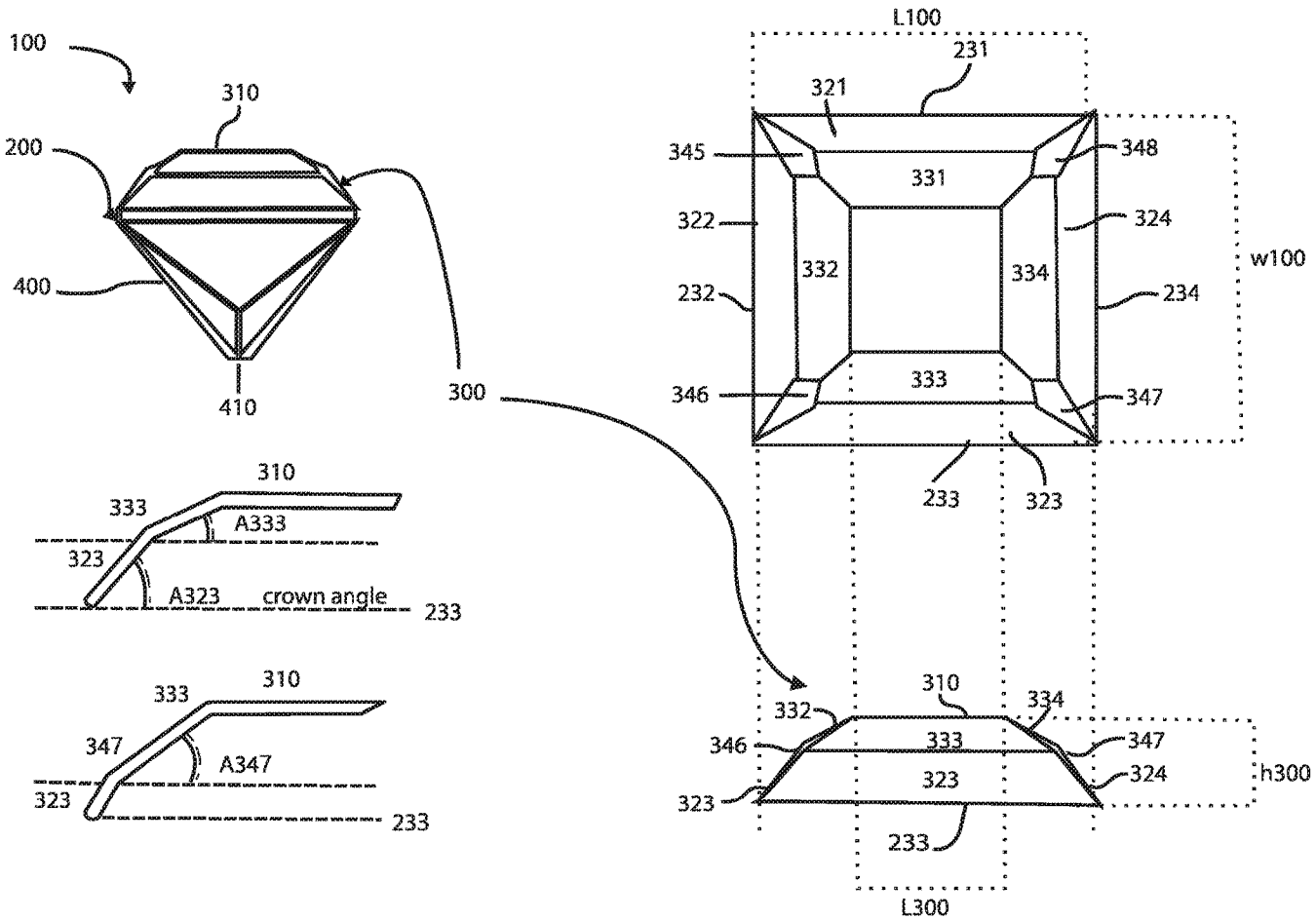
Figure 3D:
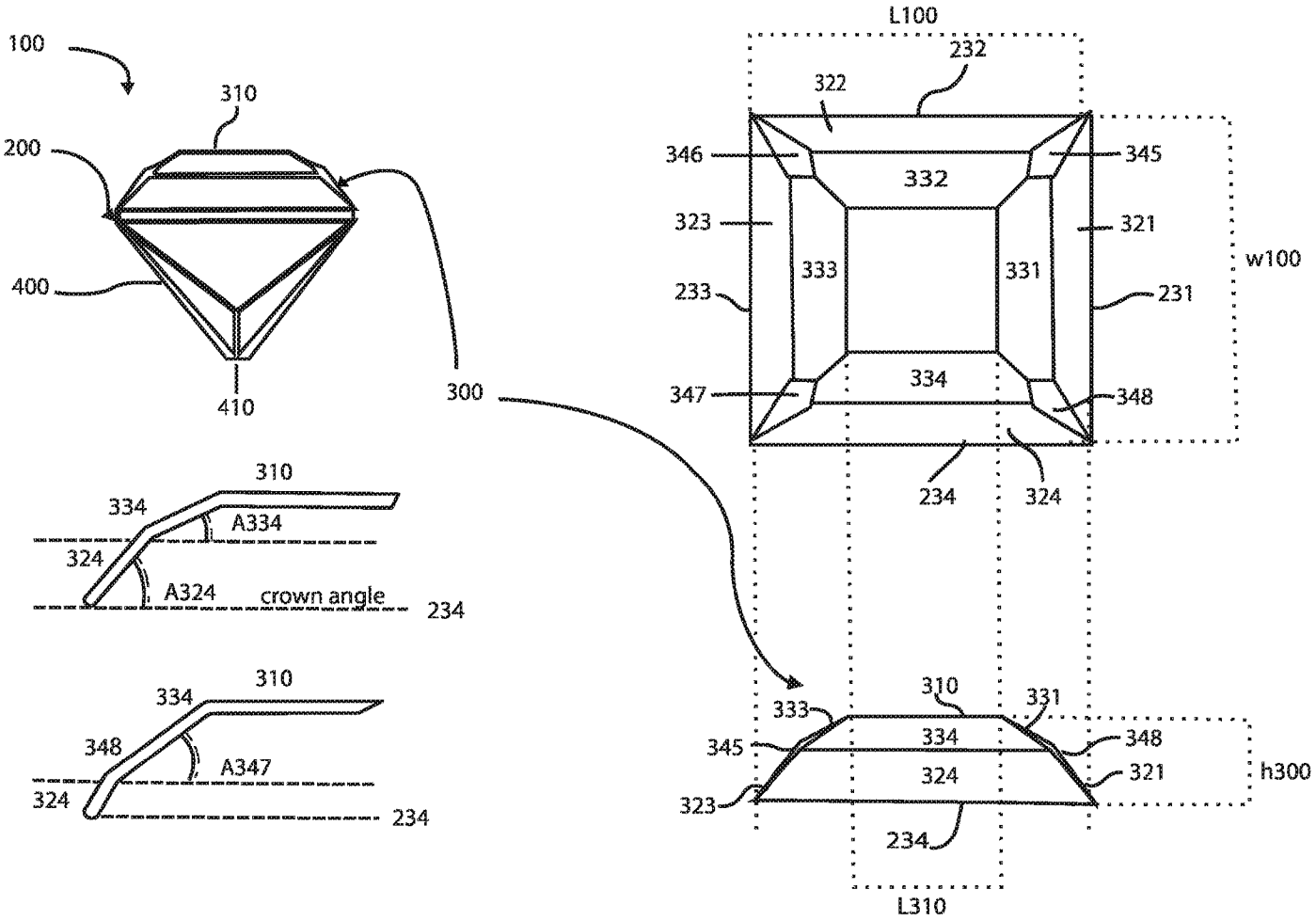
Figure 3E:
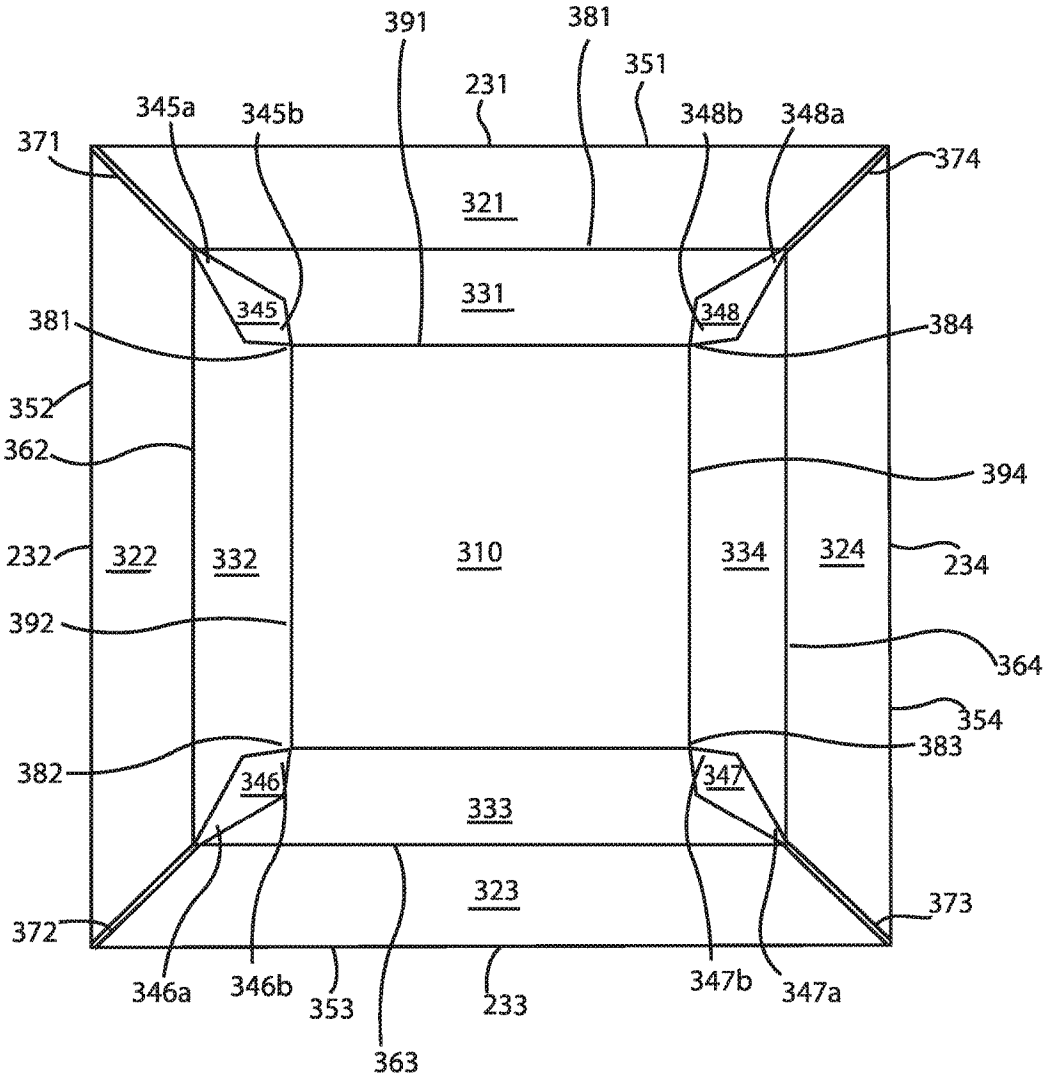
Figure 3F:
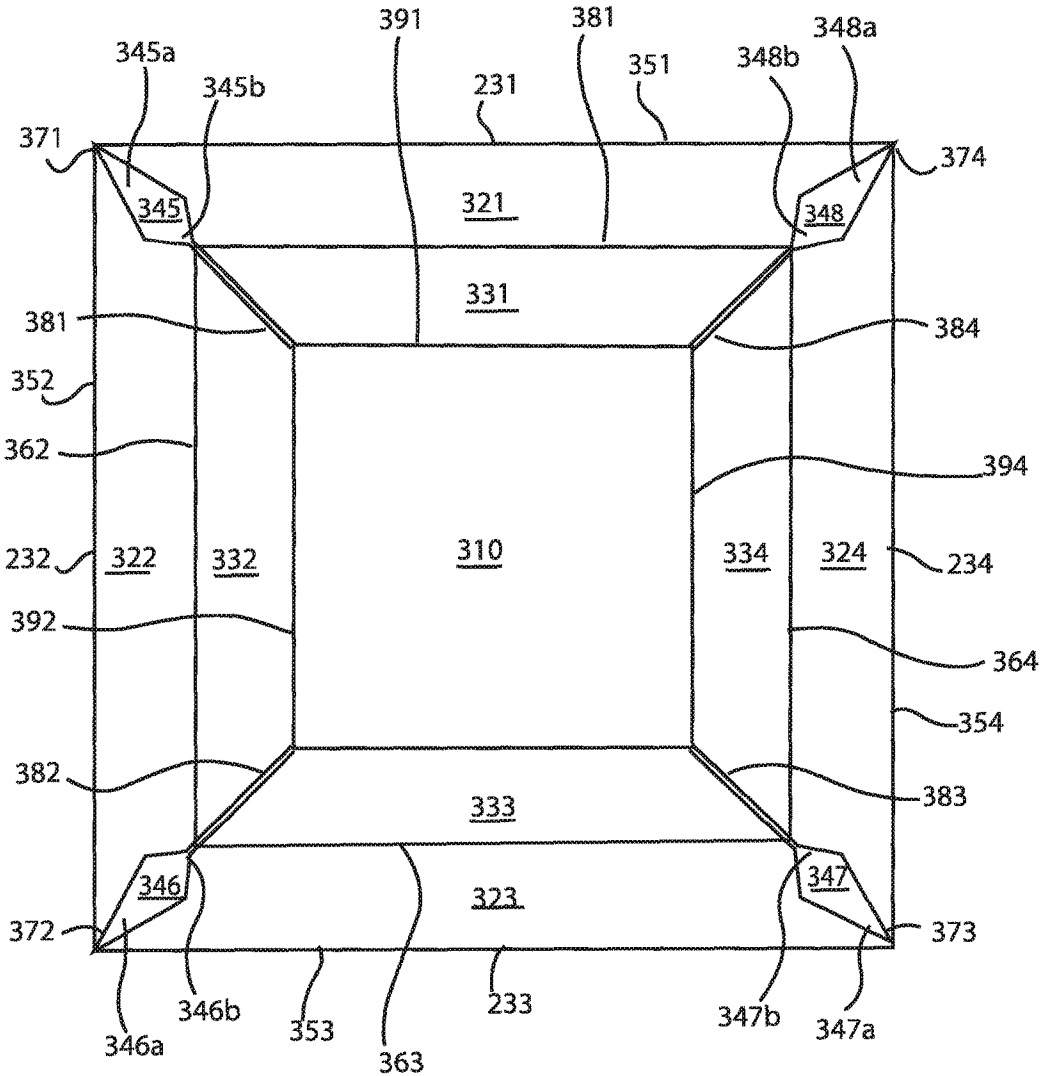
Figure 4A:
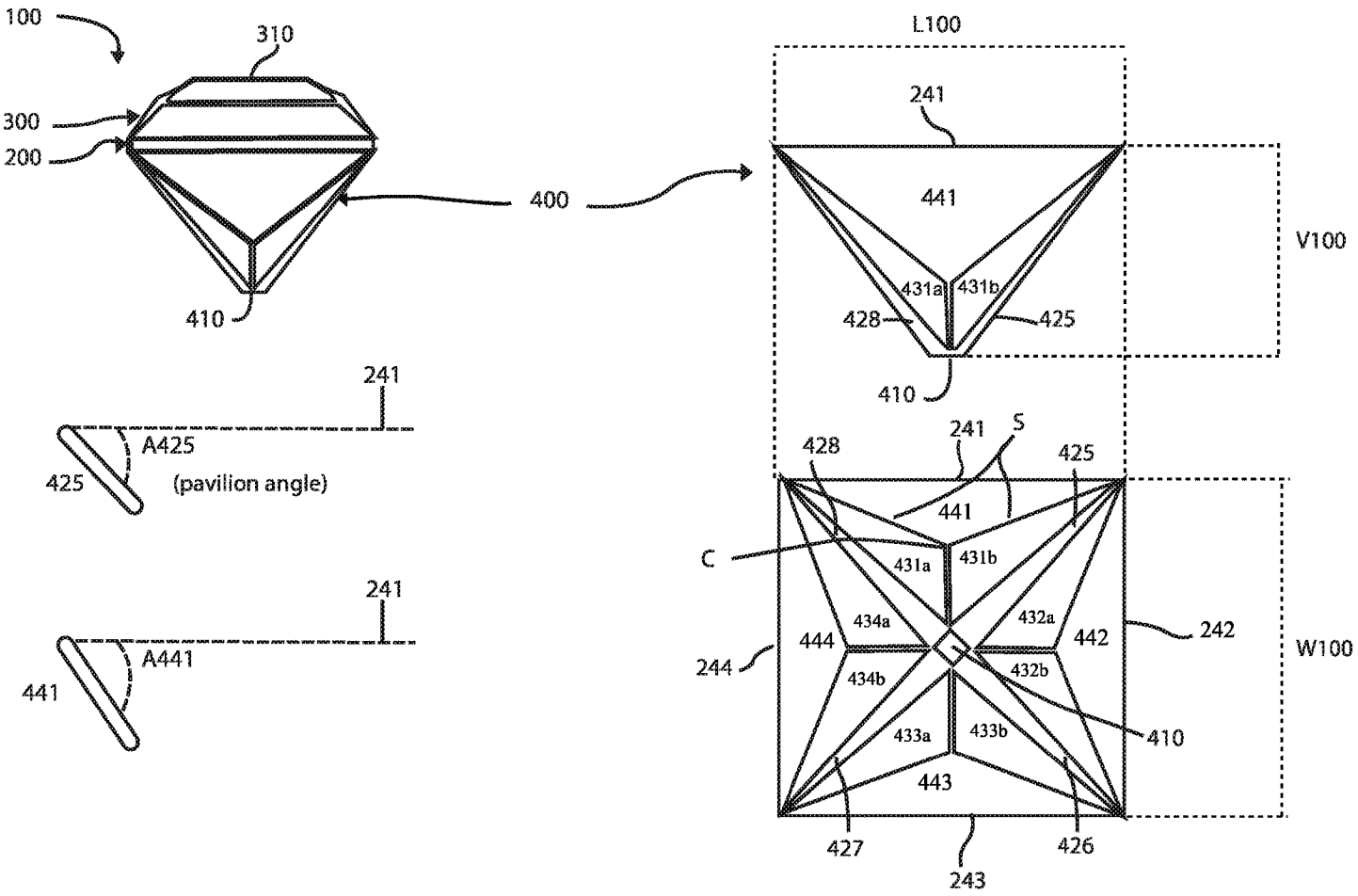
Figure 4B:
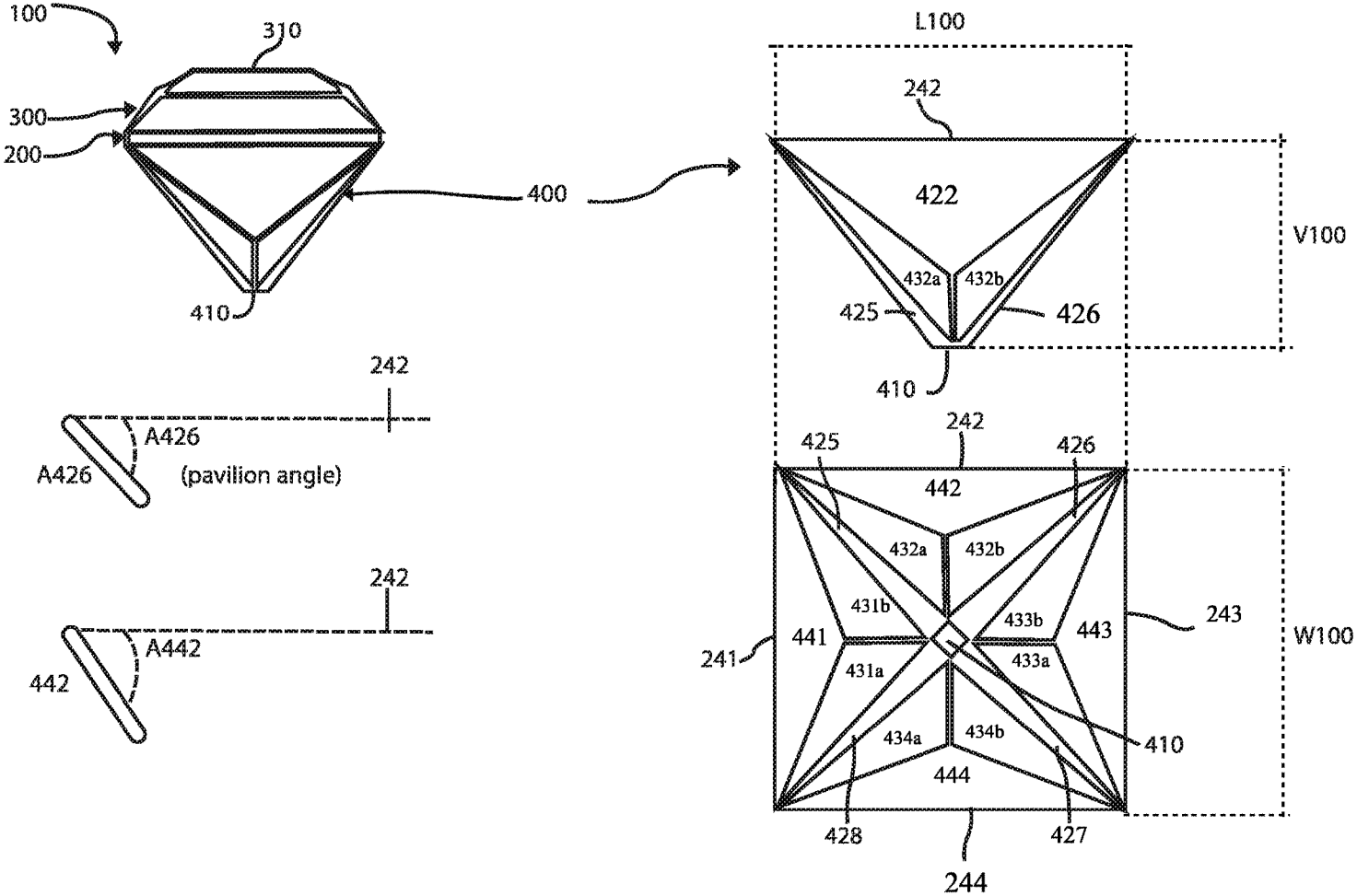
Figure 4C:
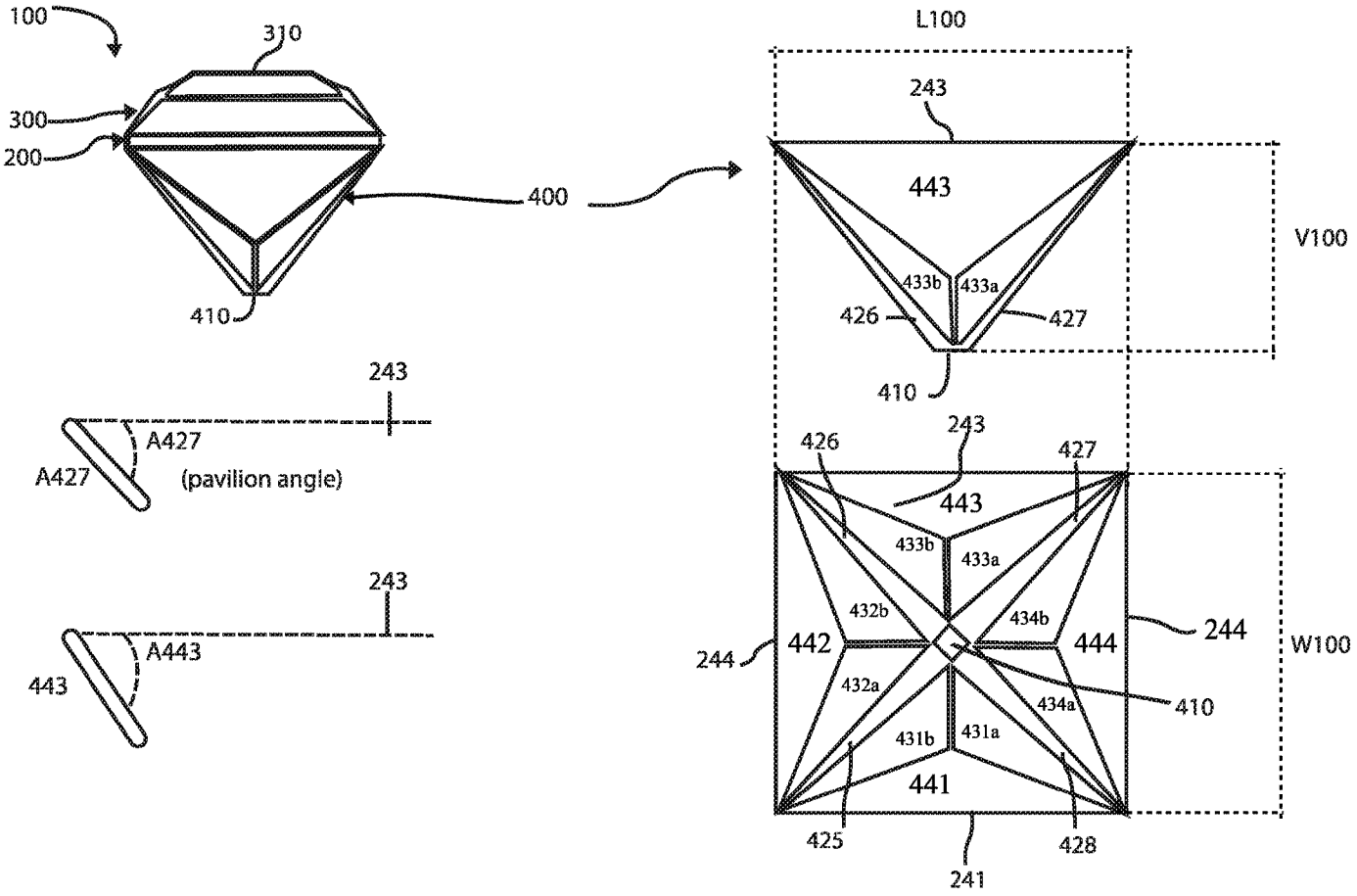
Figure 4D:
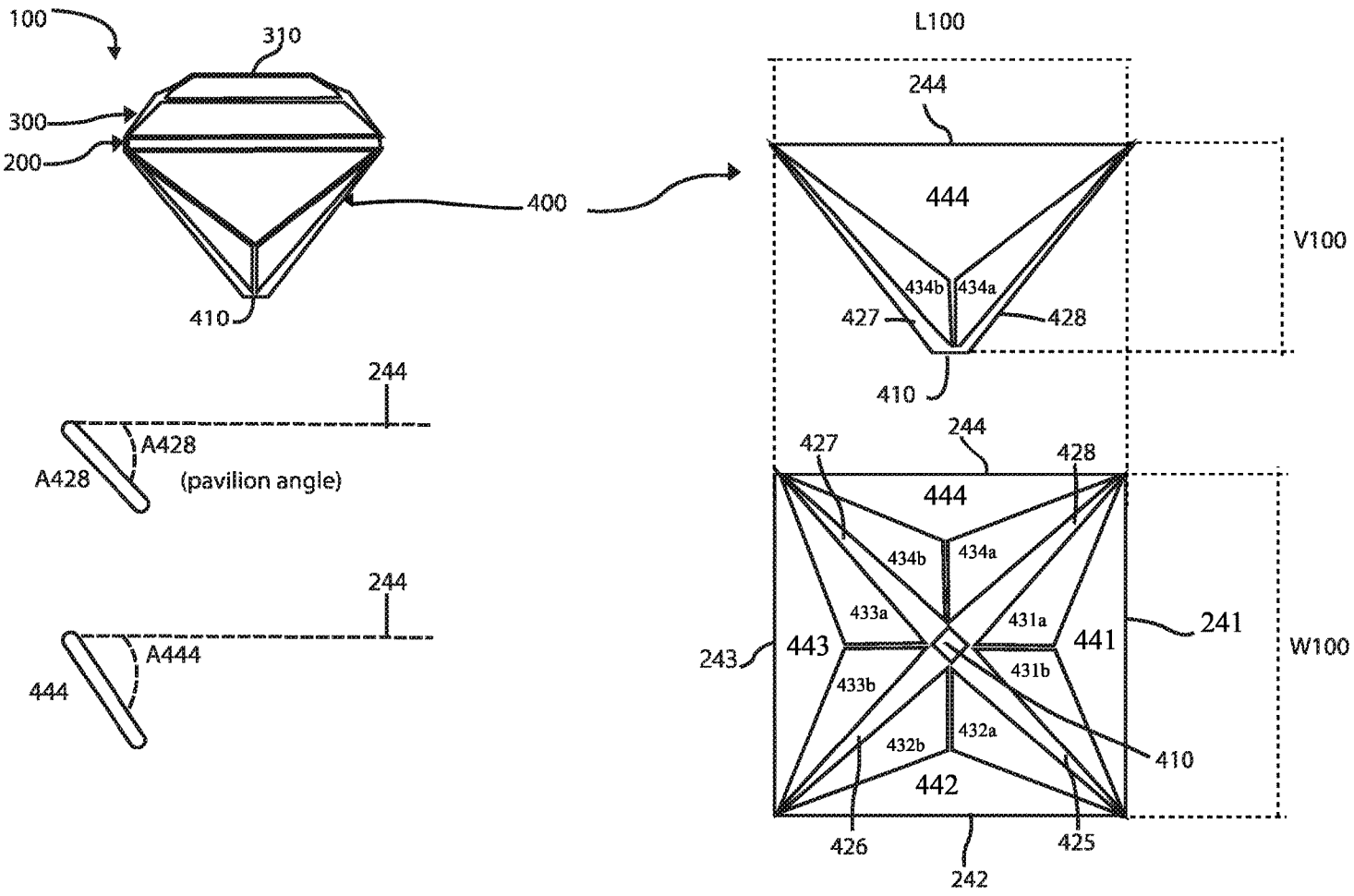

In the illustrated gemstone 100 of FIGS. 3A through 3D, the bezel facets 345, 346, 347, 348 are dimensioned so as to straddle top regions of the upper girdle facets 321-324 and to straddle bottom regions of the table-surrounding facets 341, 342, 343, 344. Thus, facets 345, 346, 347, 348 need not extend from the girdle 200 to the table 310 and, for example, bezel facets 345, 346, 347, 348 extend along a portion of each of the girdle facets and along a portion of the table-surrounding facets. That being said, the gemstone 100 in additional examples, includes bezel facets which completely straddle the corners of adjacent upper girdle facets 321-324, as shown in FIG. 3E, or which completely straddle the corners of adjacent table-surrounding facets 331-334, as shown in FIG. 3F. In such embodiments the bezel facet can straddle only the corner junctions of the upper girdle facets (321-324) such that the girdle facets (321-324) each have six sides, and the table-surrounding facets (331-334) each have four sides. In another example, the four bezel facets (345-349) straddle regions of the corner junctions of the table-surrounding facets (331-334) such that the table-surrounding facets (331-334) each have six sides, and the upper girdle facets (321-324) each have four sides The bezel facets 345, 346, 347, 348 slant upward from a horizontal plane at facet angles A345-A348. The bezel-facet angles A345-A348 are less than the upper-girdle-facet angles A321-A24 (and thus the diamond's crown angle) and greater than the table-surrounding-facet angles A331-A334.

In a perfect cut, the angles A321-A324 are equal, the angles A331-A334 are equal, and the angles A345-A348 are exactly equal. Typically, diamond cuts wherein angle-to-angle tolerances are held to less than 0.5° are considered excellently symmetric. The gemstone 100, according to various examples, has the advantage of being able to tolerate a larger angle differential among its related or adjacent facets without a sacrifice in overall diamond quality. For example, the upper-girdle-facet angles A321-A324 can vary by more than 1°, the table-surrounding-facet angles A331-A334 can vary by more than 3°, and/or the bezel-facet angles A345-A348 can vary by more than 5°, and in another example, all angles can vary from about 4% to about 5%.

FIGS. 4A through 4D illustrate various features of the gemstone pavilion according to examples of the present invention. The pavilion 400 has a generally inverted pyramid shape with its upper base formed by the girdle's lower face 240 and its peak formed by the tip 410. Thus the pavilion 400 has a square base defined by the girdle's lower edges 241-244. The tip 410 is vertically parallel to this square base and is horizontally centrally located relative thereto.

In the illustrated gemstone 100, the tip 410 is a culet forming a flattened peak in the pavilion's pyramid shape. The square culet is oriented in a horizontal plane and has sides offset 45° from the lower girdle edges 241-244. However, the tip 410 could instead be a pointed with an apex tangential to a horizontal plane. Such an apex would be considered vertically parallel to the girdle's lower face 240.

The pavilion 400 can comprise four star facets 425-428, four star-surrounding facet pairs 431(*a*) and 431(*b*), 432(*a*) and 432 (*b*), 433(*a*) and 433 (*b*), and 434(*a*) and 431(*b*), and four lower girdle facets 441-444.

The star facets 425-428 each have a slender isosceles triangular shape and they collectively occupy a relatively small area of the pavilion surface. The top peaks of the pavilion star facets 425-428 are aligned with, and preferably coincide with the corners among the girdle's lower edges 241-244. The lower bases of the pavilion star facets 425-428 coincide with tip 410.

The pavilion's star facets 425-428 each slant downward from a horizontal plane (e.g., the lower square area 240 defined by the girdle's lower edges 241-244) at facet angles A425-A428. The average of these star-facet angles A425-A428 is the pavilion angle. As was indicated above, the diamond 100 has a pavilion angle that ranges from about 39° to about 45°, and in another example from about 39° to about 43°.

In the example shown in FIGS. 4A through 4D, the four facet pairs 431(*a*) and 431(*b*), 432(*a*) and 432 (*b*), 433(*a*) and 433 (*b*), and 4(*a*) and 431(*b*) (thus eight facets in all) surround the star facets 425-428. The facets 431(*a*) and 431(*b*), are situated between star facet 428 and star facet 425, the facets 432(*a*) and 432 (*b*) are situated between star facet 425 and star facet 426, the facets 433(*a*) and 433 (*b*) are situated between star facet 426 and star facet 427, and the facets 434(*a*) and 431(*b*) are situated between star facet 427 and star facet 428.

The star-surrounding facets 431-434 each have a triangular shape with a long side (L), a short side (S), and a connecting side (C) therebetween. The long side of each facet coincides with the side of the closest star facet. The short sides of the paired facets merge with each other.

The four lower girdle facets 441-444 each have a wide isosceles triangle shape. The longer base of each facet 441-444 coincides with the girdle's lower edges 241, 242, 243, 244. The equal sides of each facet 441-444 coincide with the connecting sides of neighboring facet pairs 431-434 whereby their peaks meet at the shared boundaries therebetween.

The lower girdle facets 441-444 extend downward from a horizontal plane (e.g., the square area 240 defined by the girdle's lower edges 241-244) at angles A441-A444. The lower-girdle-facet angles A441-A444 are greater than the star-facet angles A425-A428 and thus greater than the pavilion angle. The lower-girdle-facet angles are range from about 50° to about 60°, in another example from about 55° and 62°.

In a perfect cut, the star-facet angles A425-A428 are equal and the lower-girdle-facet angles A441-A444 are equal. Typically a tolerance of 1.2° between related pavilion angles is considered acceptable and will not unduly upset symmetry and thus diamond grading. With the gemstone 100, larger tolerances can be enjoyed without a decline of intensity, brightness, fire, and/or scintillation. The tolerance for the star-facet angles A425-A428 and/or the tolerance for the lower-girdle-facet angles A441-A444 can be, for example, greater than 2°, in another example the tolerance can range from about 0.5° to about 5°.

Figure 5:
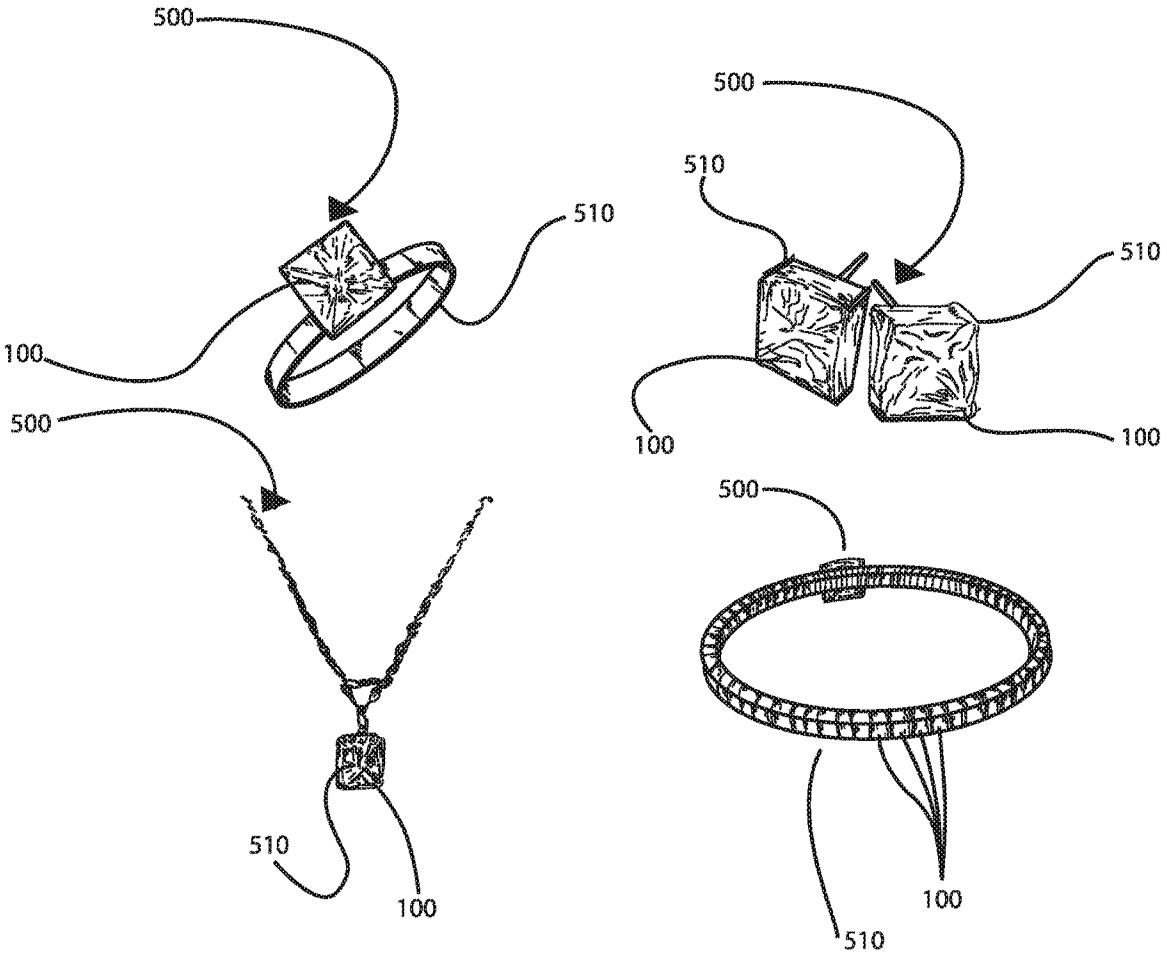
FIG. 5 shows the diamond 100 mounted on jewelry pieces 500. in accordance to an example of the present invention.

FIG. 5 illustrates different examples of jewelry 500 that includes one or more gemstone 100. The square princess cut diamond 100 can be incorporated into jewelry 500 via mounting hardware 510. The mounting hardware 510 secures one or more gemstones 100 and can be adapted to make finished jewelry, including but not limited to, a ring, an earring, a bracelet, a necklace and combinations thereof. One or more gemstones 100 included in jewelry 500 can include one or more type of natural or synthetic gemstone, for example a diamond, a ruby and an emerald, etc.

A sample embodiment 600 of the diamond 100 was tested for intensity, brightness, fire, and scintillation the details of which are described in the Examples below. Example diamond 100 was a princess cut, in accordance with an example of the present invention, and that has a crown with 13 crown facets (including the table facet) and 18 pavilion facets, including extra facets 632 and 634, for a total of 35 gemstone facets, including four girdle facets, with a point tip 636 having an apex tangential to a horizontal plane. When compared to traditional classifications for square princess cuts, the diamond 600 has a length-width ratio (1.03) which satisfies premium standards (e.g., 0.95-1.05). By current industry standards, diamond 600's overall depth (83.3%) is considered average as opposed to premium (e.g., 64% to 75%) or fine (e.g., 58% to 80%). The table size (50.7%) of the diamond 600 is classified as below average instead of average (e.g., 55% to 85%) or above average. Its girdle thickness (5.2%) falls within premium setpoints (e.g., 1.0% to 5.5%). The diamond's crown height (16.7%) is considered to be within the fine spectrum (e.g., 6% to 18%).

The crown 300 angles A321-A324 varying from 44.7° to 46.5° (e.g., greater than 0.5° differential), angles A331-A334 varying from 22.8° to 26.5° (e.g., greater than 3.00 differential), and bezel facets 245-248 varying from 28.2° to 29.1° (e.g., greater than 0.5° differential). The pavilion angles A425-A428 vary from 40.0° to 41.2° (e.g., greater than 10 differential) and the pavilion angles A441-A444 vary from 57.20 to 60.9° (e.g., more than a 2° differential).

The pavilion 400 of the diamond 600 has an extra star-surrounding facet 632 and an extra star-surrounding facet 634. Extra diamond facets can be added to the pavilion to remove inclusions and internal flaws found in the crystalline structure of the stone being cut.

The symmetry of the diamond 600 is considered poor due its angle variance and extra facets 632 and 634. Such non-symmetry is usually blamed for inferior scintillation and other desirable diamond properties. But despite this poor symmetry, the diamond 600 still had a high intensity level (71.7% to 77.9%). Measurement results show it had excellent brightness, excellent fire, and excellent scintillation, thereby registering triple-excellent ratings. These values are akin to those achieved by a conventional square princess cut diamond with many more crown facets and which much superior symmetry. Gemstones of the present invention achieve even improved brightness, fire and scintillation with greater balance and symmetry.

Figure 7:
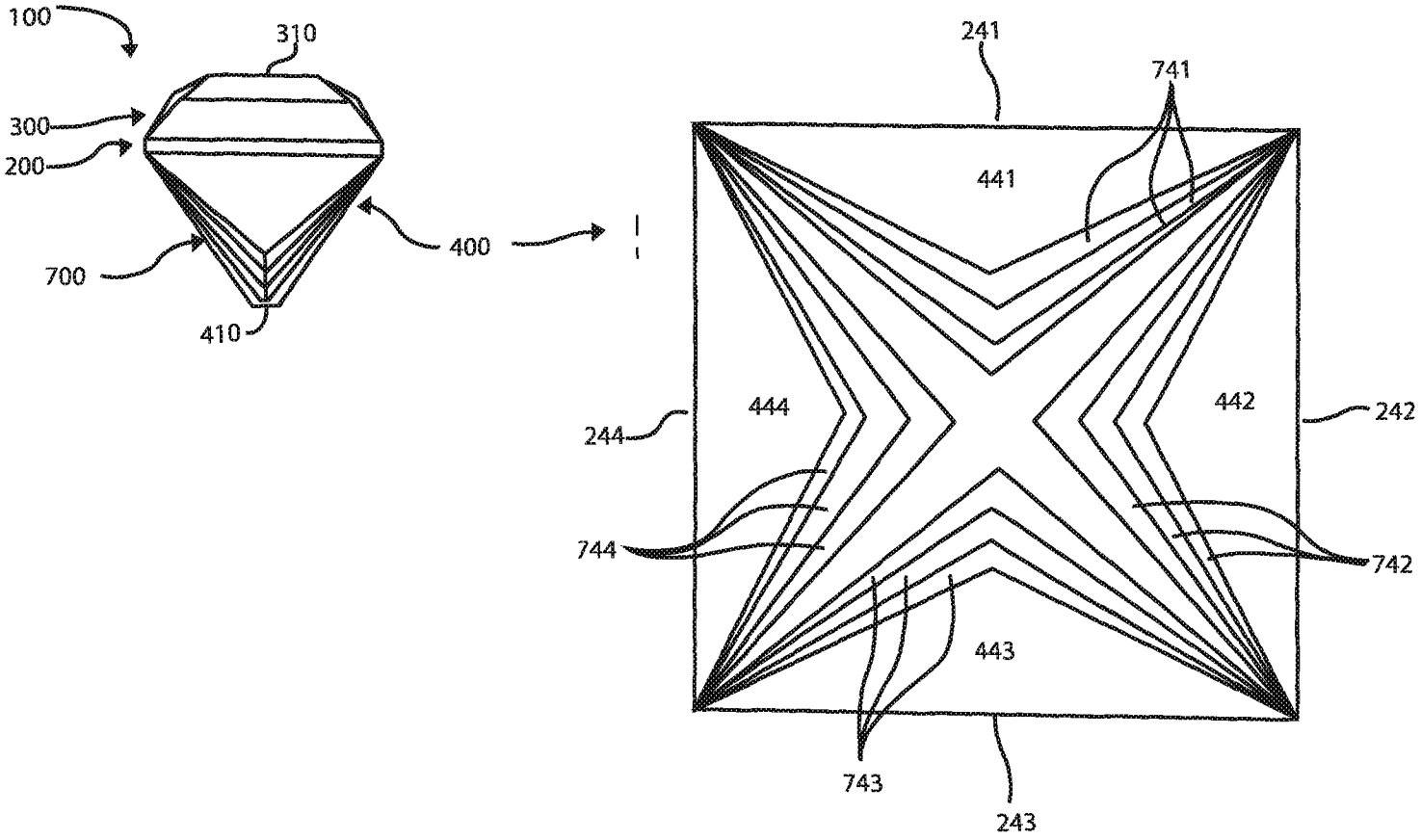
FIG. 7 shows a gemstone with chevrons 700 in the pavilion, in accordance to an example of the present invention.

As was indicated above, the pavilion 400 (FIGS. 4A-4D) can comprise four star facets 425-428, four star-surrounding facet pairs 431-434, and four lower girdle facets 441-444. This pavilion facet arrangement will work well in many instances. However, FIG. 7 illustrates the incorporation of a chevron array 700 into the pavilion 400, according to another example of the present invention. The incorporation of chevrons may be desirable with some gemstones, for example some diamonds. Specifically, for example, chevrons 741-744 can be added to, or used instead of the star-surrounding facet pairs described with respect to FIGS. 4A-4D. With the illustrated chevron array 700, three chevrons are situated between each adjacent pair of star facets 425-428. Depending upon diamond characteristics, the chevron count can be adjusted to achieve optimum ratings. The example gemstone 100 of FIG. 7 has 32 facets plus culet 410 for a total of 33 pavilion facets. Therefore, the total number of gemstone facets is 50, including 13 crown facets and four girdle facets.

In order to more fully and clearly describe examples of the present invention, the following examples are given. The examples are intended to illustrate examples of the invention and should not be construed as limiting the invention disclosed and claimed herein in any manner.

In accordance with another aspect of the present invention any of the gemstones described above has a crown that has at least 13 facet, in another example, a maximum of 13 facets including the central table facet and substantially twelve (12) additional crown facets, including, four table-surrounding facets, four bezel facets, and four upper-girdle facets. The gemstone also has a pavilion which has at least 16 facets and can typically range from 16 to 33, and so the total number of facets of the gemstone is at least about 33 facets, and in another example the gemstone can have from about 33 to about 50 facets. In another example, the gemstone has a maximum of 34 facets, in another example a maximum of 41 facets, in another example a maximum of 42 facets, in another example a maximum of 49 facets, and in another example a maximum of 50 facets.

EXAMPLES

Example 1

Figure 6:
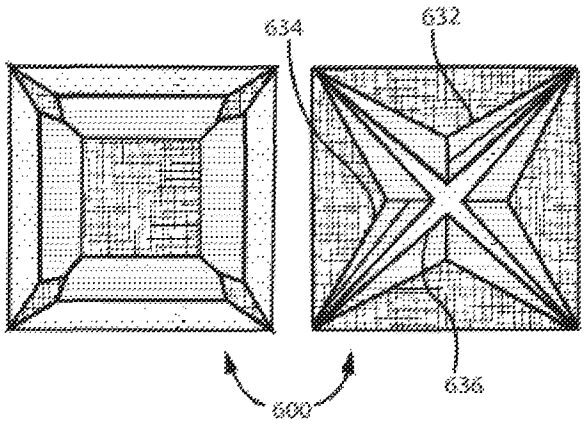
FIG. 6 shows dimensions and angles of an example embodiment 600 of a diamond, and the measured intensity, brightness, fire, and scintillation therefor, in accordance to an example of the present invention.

A sample embodiment of diamond 600 (FIG. 6) was tested for intensity, brightness, fire, and scintillation. This testing was performed on a Scanox Proportion HD high resolution proportion system which is commercially available from OGI Systems Ltd. This system was designed for use in situations (e.g., labs) requiring maximum accuracy during diamond scanning.

The properties of diamond 600, including cuts, are listed below in Table 1. The results for intensity, brightness, fire, and scintillation is listed in Table 2.

TABLE 1

| Property | Measurement | Angle Reference | Angle |
|---|---|---|---|
| Weight | 2.94 Ct. | A321 | 46.5° |
| L/W | 1.03 | A322 | 46.1° |
| Overall Depth | 83.3% | A323 | 44.7 |
| Table Size | 50.7% | A324 | 46.4 |
| Girdle Thickness | 5.2% | A331 | 26.2° |
| Crown Height | 16.7% | A332 | 26.5° |
| Pavilion Depth | 61.4% | A333 | 22.8° |
| Crown Angle | 45.9% | A334 | 24.9° |
| Pavilion Angle | 40.6% | A335 | 29.1° |
| L100 | 7.58 mm | A346 | 28.3° |
| W100 | 7.39 mm | A347 | 28.2° |
| H100 | 7.49 mm | A348 | 28.9° |
| H310 | 3.80 mm | A425 | 41.2° |

TABLE 1-continued

| Property | Measurement | Angle Reference | Angle |
|---|---|---|---|
| V200 | 0.4 mm | A426 | 40.0° |
| V300 | 1.3 mm | A427 | 40.2° |
| V400 | 4.6 mm | A428 | 41.0° |
| — | — | A441 | 60.9° |
| — | — | A442 | 57.2° |
| — | — | A443 | 59.4° |
| — | — | A444 | 60.6° |

Examples 2 Through 5

Square princess cut diamond gemstones having the properties listed in Table 2 were (tested for intensity, brightness, fire, and scintillation. All four crowns are of the type shown in FIG. 6, having a square table, four (4) six-sided upper girdle facets, four (4) six-sided table-surrounding facets, and four bezel facts, each of which straddle a portion of the upper-girdle facets and a portion of the table-surrounding facets.

All testing was performed on the equipment described above in Example 1. The results showed that these gemstones performed at the top portion of the excellent scale of the Scanox Proportion HD high resolution proportion system.

TABLE 2

| Properties | Example 1 (FIG. 6) | Example 2 | Example 3 | Example 4 |
|---|---|---|---|---|
| Weight: | 2.94 | 1.99 Ct. | 1.81 Ct. | 1.98 Ct |
| L/W | 1.03 | 1.00 | 1.0 | 1.02 |
| Crown Angle | 45.9° | 45.8° | 45.1° | 47.5° |
| Crown Height | 16.7% | 16.9 | 19.0% | 18.5% |
| Crown Facets | 13 | 13 | 13 | 13 |
| Pavilion Angle | 40.6° | 41.1° | 40.6° | 41.7° |
| Pavilion Depth | 61.4% | 61.4% | 61.2% | 61.7% |
| Pavilion Facets | 21 | 19 | 21 | 21 |
| Table Size | 50.7 | 53.3 | 48.8% | 49.5% |
| Girdle Thickness % | 5.2% | 3.4% | 8.9% | 15.1% |
| Girdle Thickness mm | 5.55 mm | 5.42 mm | 5.65 mm | 5.71 mm |
| Total Depth | 83.3% | 83.3% | 89% | 95.3% |
| Crown Intensity | 77.9% | 77.1% | 74.9 | 73.1 |
| Brightness | Excellent | Excellent | Excellent | Excellent |
| Fire | Excellent | Excellent | Excellent | Excellent |
| Scintillation | Excellent | Excellent | Excellent | Excellent |

The example diamonds had excellent brightness, fire, and scintillation, and intensities greater than 70% were found in the various examples. Examples 3 and 4 had large girdle thicknesses yet had excellent performance. Although the above examples are diamonds, other gemstones can be substituted for diamonds. For example, precious gemstones (sapphires, emeralds, rubies, alexandrite, etc.), semi-precious gemstones (amethyst, garnet, morganatic, etc.), and/or synthetic gemstones are also suitable candidates for the specified square cut. And the disclosed cut is especially advantageous with raw stones that have below average starting colors, as the excellent light return compensates for the inherent shortcoming.

While the examples of the present invention have been illustrated by the description of gemstone 100, the girdle 200, the crown 300, the pavilion 400, the jewelry 500, the sample 600, and/or the chevrons 700, have been shown and described as having certain forms and fabrications, such portrayals represent only some of the possible adaptations of the claimed characteristics. While alternative examples have been described, it is not the intention of the applicant to restrict or in any way limit the scope of the appended claims to the details herein. Additional advantages and modifications will readily appear to those of ordinary skill in the art. Accordingly, departures may be made from such details without departing from the spirit or scope of the applicant's general inventive concepts and which are intended to be encompassed by the following claims.

What is claimed is:

1. A rectangular cut gemstone (100) comprising:

a girdle (200);

a crown (300);

a pavilion (400);

the girdle (200) comprising four rectangular facets (211-214), four upper edges (231-234) and four lower edges (241-244);

the four upper edges (231-234) of the girdle (200) defining an upper rectangular area (230);

the four lower edges (241-244) of the girdle (200) defining a lower rectangular area (240);

the crown (300) comprising a lower base and only thirteen facets consisting of a table facet (310), four upper girdle facets (321-324), four table-surrounding facets (331-334) and four bezel facets (345-348);

the lower base being formed by the upper rectangular area (230) defined by the four upper edges (231-234) of the girdle (200);

the pavilion (400) being situated below the girdle (200) and based upon the lower rectangular area (240);

the pavilion (400) comprising a tip (410);

the tip (410) being a rectangular culet;

the table facet (310) forming a horizontal top of the crown (300);

the table facet (310) comprising a rectangular shape and four edges running parallel to the four upper edges (231-234) of the girdle (200);

the four upper girdle facets (321-324) comprising four lower edges and four upper edges;

the four lower edges of the four upper girdle facets (321-324) abutting with the four upper edges (231-234) of the girdle (200);

the four upper edges of the four upper girdle facets (321-324) being positioned parallel to the four lower edges of the four upper girdle facets (321-324);

the four table-surrounding facets (331-334) comprising four lower edges and four upper edges;

the four lower edges of the four table-surrounding facets (331-334) abutting with the four upper edges of the four upper girdle facets (321-324);

the four upper edges of the four table-surrounding facets (331-334) being positioned parallel to the four lower edges of the four table-surrounding facets (331-334);

the four upper edges of the four table-surrounding facets (331-334) abutting with the four edges of the table facet (310);

the four bezel facets (345-348) straddling four corner junctions of the four upper girdle facets (321-324) and/or four corner junctions of the four table-surrounding facets (331-334);

the four bezel facets (345-348) each being of a kite shape;

a distance between the rectangular facet (211) of the girdle (200) and the rectangular facet (213) of the girdle (200) defining a length (L100) of the rectangular cut gemstone (100);

a distance between the rectangular facet (212) of the girdle (200) and the rectangular facet (214) of the girdle (200) defining a width (W100) of the rectangular cut gemstone (100);

an average of the length (L100) of the rectangular cut gemstone (100) and the width (W100) of the rectangular cut gemstone (100) being a horizontal dimension (H100) of the rectangular cut gemstone (100);

a distance between the table facet (310) of the crown (300) and the tip (410) of the pavilion (400) defining a vertical dimension (V100) of the rectangular cut gemstone (100);

the four edges of the table facet (310) defining a length (L310) of the table facet (310) and a width (W310) of the table facet (310);

an average of the length (L310) of the table facet (310) and the width (W310) of the table facet (310) being a horizontal dimension (H310) of the table facet (310);

a distance between the upper rectangular area (230) of the girdle (200) and the lower rectangular area (240) of the girdle (200) defining a vertical dimension (V200) of the girdle (200);

a distance between the upper rectangular area (230) of the girdle (200) and the table facet (310) defining a vertical dimension (V300) of the crown (300);

a distance between the lower rectangular area (240) of the girdle (200) and the tip (410) defining a vertical dimension (V400) of the pavilion (400);

a length-to-width ratio (L100/W100 or W100/L100) being 1.0 to 1.1;

an overall depth ratio (V100/H100) being 80% to 105%;

a table size ratio (H310/H100) being 48% to 52%;

a girdle thickness ratio (V200/H100) being 5% to 21%;

a crown height ratio (V300/H100) being 15% to 24%;

a pavilion depth ratio (V400/H100) being 58% to 65%;

a crown angle;

the crown angle being 45.5° to 47°;

the four upper girdle facets (321-324) slanting upward from a horizontal plane at four upper girdle-facet angles (A321-A324);

an average of the four upper girdle-facet angles (A321-A324) being the crown angle;

a pavilion angle;

the pavilion angle being 39.5° to 45°;

the pavilion (400) comprising four star facets (425-428);

the four star facets (425-428) slanting downward from a horizontal plane at four star-facet angles (A425-A428); and an average of the four star-facet angles (A425-A428) being the pavilion angle.

2. The rectangular cut gemstone (100) as set forth in claim 1 comprising the rectangular cut gemstone (100) being a diamond.

3. The rectangular cut gemstone (100) as set forth in claim 1 comprising:

the four bezel facets (345-348) straddling the four corner junctions of the four upper girdle facets (321-324) and the four corner junctions of the four table-surrounding facets (331-334);

the upper girdle facets (321-324) each comprising a trapezoidal shape; and the table-surrounding facets (321-324) each being modified trapezoid with six sides.

4. The rectangular cut gemstone (100) as set forth in claim 1 comprising the four bezel facets (345-348) each comprising four edges, the four edges forming the kite shape.

5. The rectangular cut gemstone (100) as set forth in claim 1 comprising the pavilion (400) comprising:

the four star facets (425-428) of the pavilion (400) extending downward from four corner junctions of the four lower edges (241-244) of the girdle (200) to the tip (410) of the pavilion (400);

four lower girdle facets (441-444); and the four lower girdle facets (441-444) of the pavilion (400) extending downward from the four lower edges (241-244) of the girdle (200).

6. The rectangular cut gemstone (100) as set forth in claim 5 comprising the pavilion (400) comprising four facet pairs (431-434) surrounding the four star facets (425-428).

7. The rectangular cut gemstone (100) as set forth in claim 1 comprising the rectangular cut gemstone (100) comprising a total number of facets ranging from 33 to 38 facets.

8. A jewelry (500) comprising a hardware (510) and a rectangular cut gemstone (100) as set forth in claim 1 mounted in the hardware (510).

9. The jewelry (500) as set forth in claim 8 comprising the hardware (510) being selected from the group consisting of ring, earring, necklace and bracelet.

* * * * *